US010670228B2

(12) United States Patent
Di Trapani et al.

(10) Patent No.: US 10,670,228 B2
(45) Date of Patent: Jun. 2, 2020

(54) SUN-SKY IMITATING LIGHTING SYSTEM WITH ENLARGED PERCEIVED WINDOW AREA

(71) Applicant: COELUX S.R.L., Lomazzo (IT)

(72) Inventors: Paolo Di Trapani, Cavallasca (IT); Davide Magatti, Capiago Intimiano (IT)

(73) Assignee: CoeLux S.r.l., Lomazzo (CO) (IT)

( * ) Notice: Subject to any disclaimer, the term of this patent is extended or adjusted under 35 U.S.C. 154(b) by 0 days.

(21) Appl. No.: 16/081,689

(22) PCT Filed: Mar. 7, 2016

(86) PCT No.: PCT/EP2016/054817
§ 371 (c)(1),
(2) Date: Aug. 31, 2018

(87) PCT Pub. No.: WO2017/152940
PCT Pub. Date: Sep. 14, 2017

(65) Prior Publication Data

US 2019/0101263 A1 Apr. 4, 2019

(51) Int. Cl.
*F21V 9/02* (2018.01)
*F21S 8/02* (2006.01)
(Continued)

(52) U.S. Cl.
CPC ..... *F21V 9/02* (2013.01); *F21S 8/024* (2013.01); *F21S 8/026* (2013.01); *F21V 13/02* (2013.01);
(Continued)

(58) Field of Classification Search
CPC ..... F21V 9/02; F21V 13/02; F21V 7/0008; F21V 9/00
See application file for complete search history.

(56) References Cited

U.S. PATENT DOCUMENTS 8,068,285 B1 11/2011 Flynn
9,976,718 B2 5/2018 Ueki et al.
(Continued)

FOREIGN PATENT DOCUMENTS

CN 102341641 A 2/2012
CN 102419414 A 4/2012
(Continued)

OTHER PUBLICATIONS

T.C. Grenfell et al., "Representation of a non-spherical ice particle by a collection of independent spheres for scattering and absorption of radiation," Journal of Geophysical Research, vol. 104, No. D24, pp. 31,697-31,709 (13 total pages), Dec. 27, 1999.
(Continued)

*Primary Examiner* — Anabel Ton
(74) *Attorney, Agent, or Firm* — DiBerardino McGovern IP Group LLC

(57) ABSTRACT

A lighting system (1) for in particular forming a room edge (12) of a room comprises an enlarged sky-perception providing unit (2) with a light transparent panel (3) and a mirror unit (13) with a reflective face (13A) forming an inner edge (14), the lighting system further comprises a light source (41) configured to emit a direct light beam (43) through the light transparent panel (3) onto the mirror unit (13) such that the transmitted portion (9) of the light beam is reflected completely by the reflective face (13A), thereby creating a reflected direct light beam (17) in particular for imitating a sun beam.

24 Claims, 5 Drawing Sheets

(51) Int. Cl.
*F21V 13/02* (2006.01)
*F21V 7/00* (2006.01)
*F21Y 101/00* (2016.01)

(52) U.S. Cl.
CPC ..... *F21V 7/0008* (2013.01); *F21Y 2101/00* (2013.01)

(56) References Cited

U.S. PATENT DOCUMENTS

| | | | | |
|---|---|---|---|---|
| 2002/0122305 | A1 | 9/2002 | Adelhelm | |
| 2012/0014085 | A1 | 1/2012 | Minami | |
| 2012/0075829 | A1 | 3/2012 | Li et al. | |
| 2013/0155643 | A1* | 6/2013 | Meyer | G02B 6/0008 362/2 |
| 2014/0036503 | A1 | 2/2014 | Olsen | |
| 2014/0070724 | A1 | 3/2014 | Gould et al. | |
| 2015/0316231 | A1* | 11/2015 | Di Trapani | F21V 9/02 362/147 |
| 2016/0363777 | A1 | 12/2016 | Flynn et al. | |
| 2017/0074486 | A1 | 3/2017 | Flynn et al. | |

FOREIGN PATENT DOCUMENTS

| | | | |
|---|---|---|---|
| CN | 1049143267 | A | 9/2015 |
| GB | 2450192 | C | 12/2008 |
| WO | 2009156347 | A1 | 12/2009 |
| WO | 2009156348 | A1 | 12/2009 |
| WO | 2014076656 | A1 | 5/2014 |
| WO | 2015135560 | A1 | 9/2015 |
| WO | 2015172794 | A1 | 11/2015 |
| WO | 2015173770 | A2 | 11/2015 |
| WO | 2015174401 | A1 | 11/2015 |
| WO | 2017036502 | A1 | 3/2017 |

OTHER PUBLICATIONS

Remko Dinkla, European International Searching Authority, International Search Report and Written Opinion, counterpart PCT Application No. PCT/EP2016/054817, dated Apr. 22, 2016, 11 pages total.

Office Action, counterpart Chinese Patent Application No. 201680083295.0 dated Nov. 25, 2019, 11 pages total (including partial English translation of 3 pages).

Gabor Toth et al., "Sun-to-thermosphere simulation of the Oct. 28-30, 2003 storm with the Space weather Modeling Framework," Space Weather, vol. 5, S006003, doi:10.1029/2006SW00272 (Jun. 13, 2007).

Su Shi et al., "New Development of Solar Simulator," Laser & Optoelectronics Progress, doi: 10.3788/LOP49.07003(2012) (with English abstract), 8 pages.

* cited by examiner

SUN-SKY IMITATING LIGHTING SYSTEM WITH ENLARGED PERCEIVED WINDOW AREA

TECHNICAL FIELD

The present disclosure relates generally to lighting systems, in particular to lighting systems for optically providing a widened perception/impression of the ambient space and in particular for imitating natural sunlight illumination. Moreover, the present disclosure relates generally to implementing such a lighting system, for example, in an indoor room.

BACKGROUND

Artificial lighting systems for closed environments often aim at improving the visual comfort experienced by users. In particular, lighting systems are known which imitate natural lighting, specifically sunlight illumination, in particular using light with a high correlated color temperature (CCT), and a large color rendering index (CRI). The characteristics of such outdoor lighting to be imitated depend on the interaction between the sunlight and the earth atmosphere and create a specific shade characteristic.

The following disclosure is at least partly based on specific nanoparticle based Rayleigh-like scattering units, and their application in the field of active illumination such as in lighting in general. However, the generic concept may also be applicable to other embodiments of sun imitating lighting systems.

Using Rayleigh-like diffusing layers, several applications such as EP 2 30 478 A1, EP 2 304 480 A1, and WO 2014/076656 A1, filed by the same applicants, disclose lighting systems that use a light source producing visible light, and a panel containing nanoparticles used in transmission, i.e. the light source and the illuminated area are positioned on opposing sides of the panel. During operation of those lighting systems, the panel receives the light from the light source and acts in transmission as a so-called Rayleigh diffuser (herein also generally referred to as Rayleigh panel or briefly panel), namely it diffuses incident light similarly to the earth atmosphere in clear-sky conditions. Specifically, the concepts refer to directional light with lower correlated color temperature (CCT), which corresponds to sunlight, and diffused light with larger CCT, which corresponds to the light of the blue sky.

In general, for sun imitating lighting systems, an installation needs to provide for a sun-like beam extending—like the sun—in a top to bottom direction. As a consequence, the requirement of a sky-imitating at the ceiling results in space being needed for the lighting system behind the ceiling and, thus, affecting the bottom to ceiling parameters of a building/room.

Therefore, it is an object of the herein disclosed concepts to provide for sun imitating lighting systems that are less demanding on space and still provide for the visual comfort desired by users from lighting systems imitating natural lighting conditions. A further object of the herein disclosed concepts is to provide for an extended sky perception provided by lighting systems imitating natural lighting conditions.

The present disclosure is directed, at least in part, to improving or overcoming one or more aspects of prior systems.

SUMMARY OF THE DISCLOSURE

Some or all of those aspects are addressed by the subject-matters of the independent claims. Further developments of the invention are given in the dependent claims.

In a first aspect, an enlarged sky-perception providing unit for a sun-sky imitating lighting system in inner edge configuration in particular for forming a room edge is disclosed. The unit comprises a light transparent panel configured to emit diffused light from a front face, and a mirror unit with a reflective face positioned next to the light transparent panel to form an inner edge together with the light transparent panel. The size of the light transparent panel is smaller than the size of the mirror unit. This may allow the complete front face to be viewable in reflection at least from within a predefined area.

In some embodiments, the size along the direction of the inner edge of the light transparent panel, specifically the maximal extension, is smaller than the size of the mirror unit along the direction along the inner edge. For example, a width and/or a height of the front face are/is smaller than a width and/or a height of the reflective face, respectively.

In another aspect, a lighting system for in particular forming a room edge of a room comprises an enlarged sky-perception providing unit with a light transparent panel and a mirror unit with a reflective face forming an inner edge with respect to each other as, for example, described above, and a light source configured to emit a direct light beam through the light transparent panel onto the mirror unit such that the transmitted portion of the light beam is reflected completely by the reflective face, thereby creating a reflected direct light beam in particular for imitating a sun beam.

In another aspect, a room of a building comprises a room edge formed by a side wall and a ceiling. The room further comprises a lighting system with an enlarged sky-perception providing unit as, for example, described above, wherein the light transparent panel of the sky-perceived unit and the mirror unit of the unit are provided at the wall and the ceiling, respectively, or vice versa, to form an inner edge representing the transition between the side wall and the ceiling.

In another aspect, a lighting system is disclosed for forming part of a room edge of a room. The lighting system comprises an enlarged sky-perception providing unit as, for example, mentioned above with a light transparent panel having a front face and a mirror unit with a reflective face forming an inner edge with respect to each other, and a light source that is configured to emit a direct light beam through the light transparent panel in a manner that a transmitted portion of the light beam passes by the mirror unit, wherein the light transparent panel and the mirror unit form the inner edge.

In line with the above aspects, the sky-extension concept of the inventors created a—with respect to the perception—quite powerful layout of embodiments of sun-sky imitating lighting systems that can be based on lighting systems as disclosed, for example, in WO 2014/076656 A1, and provide for an enlarged perceived window area. In those embodiments, a reflective face is provided in the proximity of the Rayleigh panel, e.g. it is attached to the Rayleigh panel under an angle of for example, about 90°. Thereby "in the proximity" means that the distance between the nearest two points laying on the front face and on the reflective face, respectively is smaller than half, a third, and/or a quarter of the average width of the panel. The width is measured in this case, for example, along the direction of extension of the inner edge.

A result of the inventors' sky-extension concept is that the lighting systems—as for example disclosed in WO 2014/076656 A1—can be mounted (e.g. vertically) or configured to emit the direct light beam in an upward direction. Thereby, the light source of the lighting system can be positioned behind the lower portion of the wall and, thus, may be easier accessible than for a lighting system being mounted above the ceiling. In addition, the height of a room may be no longer affected by the installation of the lighting system. For example, a sun-sky imitating lighting system can be fit into a standard room of e.g. a height of 2.7 m. Moreover, the perceived window is increased in size due to the perceived reflected image of the Rayleigh panel.

Other features and aspects of this disclosure will be apparent from the following description and the accompanying drawings.

BRIEF DESCRIPTION OF THE DRAWINGS

The accompanying drawings, which are incorporated herein and constitute a part of the specification, illustrate exemplary embodiments of the disclosure and, together with the description, serve to explain the principles of the disclosure. In the drawings.

DETAILED DESCRIPTION

Figure 1A:
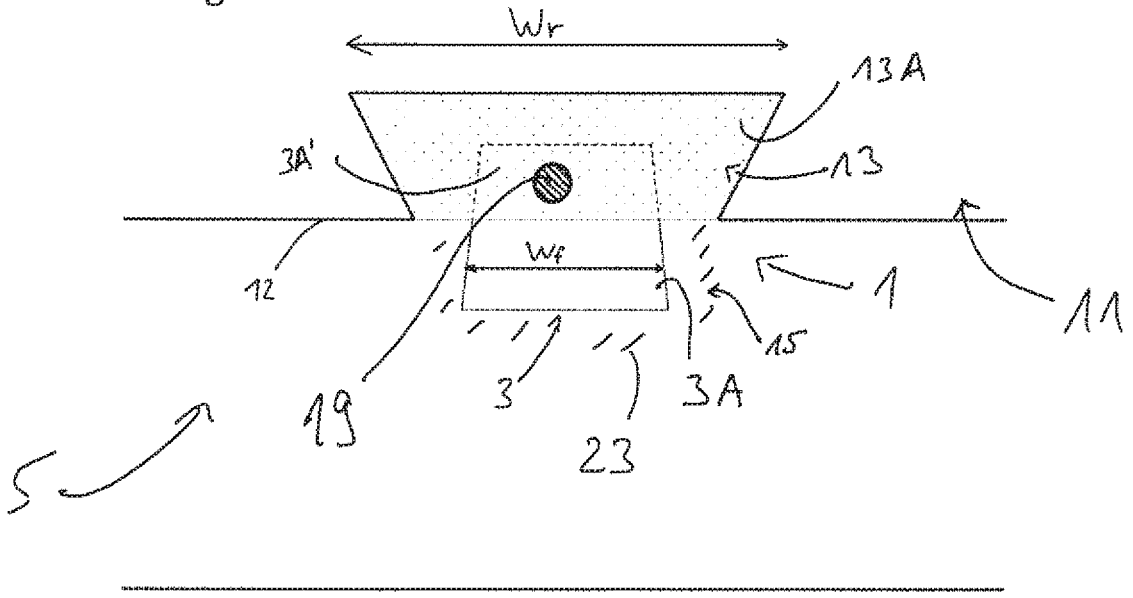
FIGS. 1A and 1B are schematic illustrations of an exemplarily lighting system for sun-sky-imitation with a sky-extension concept provided by a sky-perceived unit in a perspective view and a cross-sectional view, respectively, of a room.

The following is a detailed description of exemplary embodiments of the present disclosure. The exemplary embodiments described therein and illustrated in the drawings are intended to teach the principles of the present disclosure, enabling those of ordinary skill in the art to implement and use the present disclosure in many different environments and for many different applications. Therefore, the exemplary embodiments are not intended to be, and should not be considered as, a limiting description of the scope of patent protection. Rather, the scope of patent protection shall be defined by the appended claims.

The disclosure is based in part on the realization that to perceive sun-sky-imitation, a reduced homogeneity of the sky in perception and maintaining the desired directionality need special attention. Herein, various features are presented that alone or in combination with one or more others of those features may help ensuring the unique perception of the sun-sky-imitation in particular for an enlarged sky-perception providing unit.

The disclosure is further based in part on the realization that lighting systems for in particular indoor implementations may benefit from an perception of an enlarged window size as well as an accessibility of in particular the light source for service and replacement.

Furthermore, it was realized that there is a need for configurations that allow installations in surroundings with less available space, in particular rooms with standard height, while still providing a large window appearance. The illumination effect produced by the lighting system concepts disclosed herein is intended to give the impression of an opening in the ceiling and in the (e.g. top part of) a wall, thus, may help reducing the feeling of constraint.

For embodiments, that provide for a light well-type integration of the panel at the wall, it was further realized that any upward illumination prior the reflection of the sun beam imitating direct light beam should be avoided to not provide inconsistent "sun" illuminated faces, which would be illuminated, for example, from the bottom because this clearly stands in contrast with the expected sun-like illumination from the top. Accordingly, the light well should not be illuminated by the direct light beam, in particular prior reflection.

Furthermore, it was realized that one may at least partly adapt the size of the light beam to not extend the illumination beyond the borders of the mirror unit, specifically the reflective face. Keeping the direct light beam within the reflective face will avoid any perception of upward illumination. Similarly, the illumination of a transition unit and/or any face of a light well in a direction that is inconsistent with the expected sunlight direction may be avoided to not cause the above mentioned conflict in perception with the correct expected direction of illumination given by the propagation direction after the reflection of the direct light beam at the reflective face.

The disclosure is further based in part on the realization that the reflection of the blue sky imitation will—in case some gradient or inhomogeneity is present in the diffuse emission—create a reverse gradient or mirrored inhomogeneity such that the perception will be affected. This may appear unnatural and affect the unlimited depth perception associated with the sun-sky imitation. The inventors realized that introducing an artificial inconsistency between the "real" imitated sky and the "mirrored" imitated sky will affect the perception to be less sensitive to the unwanted change/mirroring of the gradient or inhomogeneity. Specifically, the space between the panel and the mirror is mediated by a transition unit to create the visual discontinuity.

The disclosure is further based in part on the realization that it is desirable to provide a situation where the imitated sun beam extends top down, and preferably starting from a position higher than the observer's eye. Introducing the mirror at a position of the ceiling will provide the imitating sun beam coming from above, while the sky extends at least partly at the wall. In general, the herein disclosed sky extension onto the wall will provide comfortable sky-like based illumination from the wall (as will be explained below) not sun would be seen in that portion of the window. Moreover, this allows the lighting system being easily accessible for service and installation. Accordingly, in some embodiments, the panel is vertically oriented and the mirror is positioned above the panel, e.g. horizontally along the ceiling.

Figure 1B:
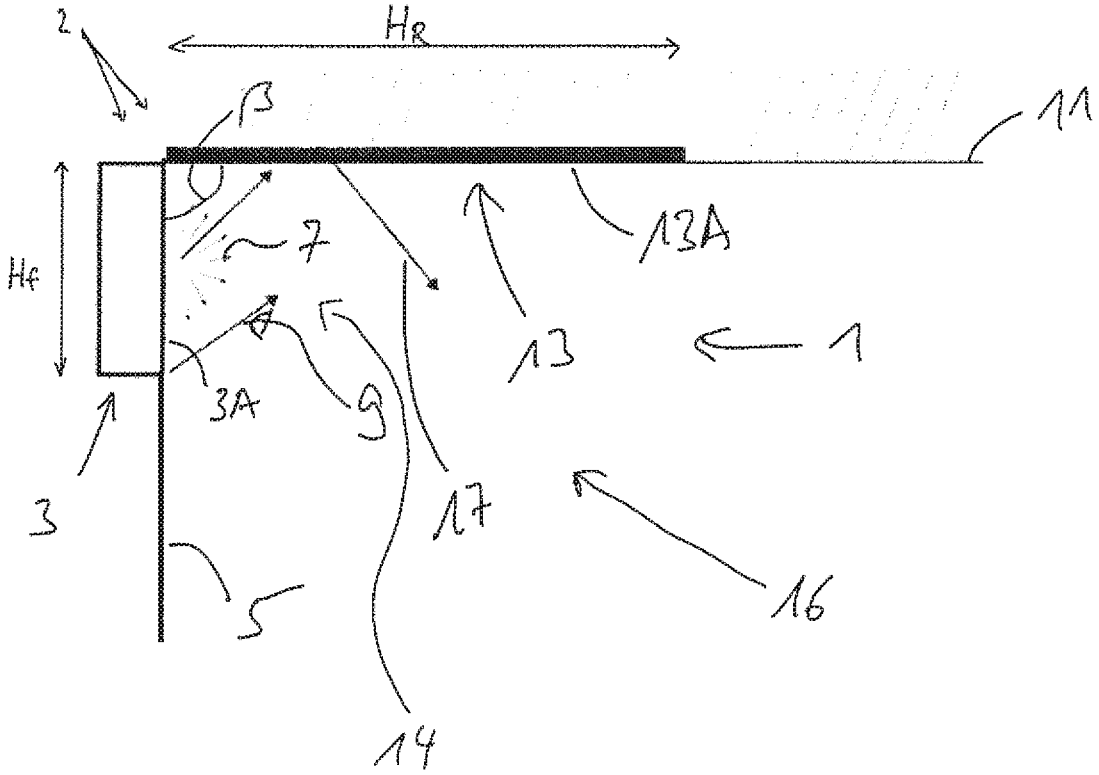

Referring to the perspective view of a room shown in FIG. 1A and the cross-sectional view of the edge of the room shown in FIG. 1B, a sun-sky imitating lighting system 1 is installed in the room to create the impression of a window through which the sun shines into the room. Lighting system 1 comprises—as a first part of an enlarged sky-perception providing unit 2—a light transparent panel 3 for diffused light generation that is operated in transmission mode. This means that a light source (not shown) is in general provided (optically) at the other side of light transparent panel 3, i.e. essentially outside of the room, while the diffuse light generation is intended for illuminating the room.

Light transparent panel 3 is installed at the upper portion of a wall 5 of the room. As will be explained in more detail below, light transparent panel 3 has a front face 3A, from which diffused light 7 is emitted. Diffused light 7 represents, for example, the imitation of a blue sky and is, thus, perceived as the light of the sky. For example, light transparent panel 3 is configured as a Rayleigh-like diffused light generator that performs based on nanoparticles a Rayleigh-like scattering of a direct light beam generated by the light source (see more detailed information on the Rayleigh-like scattering below). A transmitted portion 9 of the direct light beam is exemplary illustrated by arrows in FIG. 1B that extend from the panel 3 upward to a ceiling 11 of the room. Transmitted portion 9 of the direct light beam comprises essentially all the light that is not considered to be diffused light 7 and originates from the light source. The transition between wall 5 and ceiling 11 is referred herein as an example of a room edge 12. Assuming a vertically extending front face 3A, portion 9 of the light beam propagates, for example, at angles in the range from about 20° to 80° with respect to the vertical direction, i.e. with respect to front face 3A.

Lighting system 1 further comprises—as a second part of the enlarged sky-perception providing unit 2—a mirror unit 13 installed at ceiling 11 of the room. Mirror unit 13 has a reflective face 13A positioned and extending next to light transparent panel 3 along ceiling 11 (e.g. as forming a portion of the ceiling surface). Mirror unit 13 may comprise as reflective face 13A generally any type of optical acting interface that reflects light. For example, reflective face 13A of mirror unit 13 may be a surface of an aluminum layer or an interface between components, such as a reflective coating.

Specifically, mirror unit 13, specifically reflective face 13A, and light transparent panel 3, specifically front face 3A, form a portion of the transition between wall 5 and ceiling 11. This portion is herein referred to as an inner edge 14 of enlarged sky-perception providing unit 2 that, once unit 2 is installed in a room, is physically considered a part of room edge 12 but on the perception side is in the ideal case not recognized as a room edge by an observer. Accordingly, reflective face 13A extends at an angle with respect to front face 3A. Specifically, inner edge 14 has an inner edge angle β under which front face 3A extends with respect to reflective face 13A. Inner edge angle β is in the range from about 50° to 130° such as from about 700 to 110°. For example, front face 3A and reflective face 13A extend as planar surface at an angle between 80° and 100° such as about 90° as illustrated in FIG. 1B.

The size of front face 3A is smaller than the size of reflective face 13A. For example, a width Wf and a height Hf of front face 3A is smaller than a width Wr and a height Hr of the reflective face 13A, respectively. The width is measured in this case, for example, along the direction of extension of the inner edge, i.e. the transition between the wall and the ceiling, while the height is measured orthogonally to the width, e.g. in the plane of the front face or the reflective face, respectively. Values of width Wf and height Hf for front face 3A can be, for example, 1 m and 0.5 m, respectively, or 2 m and 1 m, respectively. Usually, the larger dimension is in the range from 0.5 m to 2 m or even up to 3 m. The smaller dimension may be of the same size or about half the size, down to about 25% or less of the size of the larger dimension. The skilled person will appreciate that the dimensions can be selected within the respective ranges freely and depend on the type of implementation of the lighting system. Accordingly, the values of width Wr and height Hr for reflective face 13A can be, for example, 1.5 m and 0.75 m, respectively, or 2.8 m and 1.5 m, respectively. Usually, a lower limit fir the dimension is the illuminated area of transmitted portion 9 in the plane of reflective face 13A.

Assuming a tilt between the front face 3A and the propagation direction of transmitted portion 9, the width Wf would be measured orthogonally to the plane given by the tilt angle, while the height would be measured in direction given by the tilt angle (as illustrated in the drawings). As will be understood by the skilled person, the tilt does not affect the width Wf compared to which the size of reflective face 13A should be larger. However, in principle the tilt may reduce the minimum requirement for the height Hr of reflective face 13A, if one just wants to ensure that transmitted portion 9 to hit onto the reflective face 13A completely. In those "tilted" beam embodiments, the height Hr may be about or even smaller than the height Hf. In the above examples, e.g. 0.5 m (or 0.3 m) as well as 1 m (or 0.8 m). Extending the height Hr, however, up to and beyond the height Hf even for tilted cases will allow an observer to see the complete front face 3A even under non-optimal observation conditions such as under a large observation angle from far away.

Moreover, the relative arrangement of front face 3A and reflective face 13A is selected such that an observer can—within a defined observation area—look at front face 3A and its surrounding 15 in reflection via mirror unit 13. In general, the complete front face 3A is viewable from within the room in reflection, in particular from within the defined observation area.

In general, unit 2 is configured such that diffused light 7 as well as the reflection of the diffused light is at least partly emitted into an inner edge angular region 16.

In addition, reflective face 13A reflects transmitted portion 9 of the direct light beam to form a reflected light beam 17 travelling in a downward direction also into inner edge angular region 16 (as illustrated by an arrow in FIG. 1B). Assuming a horizontally extending reflective face 13A, reflected light beam 17 propagates, for example, at angles in the range from about 20° to 80° with respect to the (downward) vertical direction, i.e. with respect to front face 3A assuming a vertically mounting of the same. The possibility to view the complete front face 3A is in particular given if the observer is positioned within reflected light beam 17.

Reflected light beam 17 of lighting system 1 represents the imitation of the light of the sun that falls into the room and illuminates anything it falls onto. The sun imitation is shown in FIG. 1A as a circular spot 19 in the area of a reflected image 3A' of front face 3A in reflective face 13A of mirror unit 13. Reflected image 3A' of front face 3A is indicated by dashed lines in FIG. 1A. The light source—and in particular the emitting surface of the light source and the divergence of the emitted direct light beam—is specifically configured to be perceived as a homogeneously bright area that changes its relative position within reflected image 3A' of front face 3A in dependence of the position of the observer within a range of sun-observer locations. The sun-observer locations are within the observation area mentioned above. Moreover, it is referred in the wording "sun-observer locations" exemplarily to the "sun" because an especially impressive type of embodiments of lighting system 1 relates to sun-like illumination. However, for example also moon-imitations may be performed with lighting system 1. Moving outside the sun-observer locations, the observer may still see a reflection of the diffused light (i.e. a reflection of the sky imitation) but he will be outside the divergence of the beam. Moving even out of the observation area, the reflection conditions may be such that the observer does not see the diffused light (i.e. the front face 3A) any longer but only a reflection of a portion of; e.g. the wall next to front face 3A.

An exemplary light source is, for example, disclosed in WO 2015/172794 A1. The light source in particular configured to emit light in a narrow emission solid angle to form a light beam propagating along an upward main light beam direction. For example, the light source emits light in the visible region of the light spectrum, for example, with wavelengths between 400 nm and 700 nm. Moreover, the light source emits light (visible electromagnetic radiation) with a spectral width preferably larger than 100 nm, more preferably higher than 170 nm. The spectral width may be defined as the standard deviation of the first light source's wavelength spectrum.

As indicated above, lighting system 1 comprises a diffused light generator in form of light transparent panel 3 that operates as a Rayleigh-like diffuser, which substantially does not absorb light in the visible range and which diffuses more efficiently the short-wavelength in respect to the long-wavelength components of the impinging light, e.g. panel 3 substantially does not absorb light in the visible range and diffuses light at the wavelength 450 nm (blue) at least 1.2 times, for example at least 1.4 times, such as at least 1.6 times more efficiently than light in the wavelength range around 650 nm (red), wherein a diffusion efficiency is given by the ratio between the diffused light radiant power with respect the impinging light radiant power. Optical properties and microscopic characteristic of Rayleigh-like diffusers are also described in detail in the patent application EP 2 304 478 A1 mentioned above. A further insight on the microscopic features is also provided in what follows.

Assuming an embodiment of a solid panel that is illuminated at its backside by a specifically formed light beam, light transparent panel 3 will chromatically separate the incident light beam of the light source in four components, particularly in:

a transmitted (directed non-diffuse) component (light beam 9), formed by light rays that pass through and do not experience significant deviations, e.g. is formed by light rays experiencing a deviation smaller than 0.1°; a luminous flux of the transmitted component is a significant fraction of the overall luminous flux incident on panel 3;

a forward diffuse component, formed by scattered light (referred to above as diffused light 7) propagating into the room (with the exception of that light beam direction and of directions differing from that light beam direction by an angle smaller than 0.1°); a luminous flux of the forward diffuse component corresponds to a blue skylight fraction generated from the overall luminous flux incident on the panel;

a backward diffuse component, formed by scattered light propagating away from the room; a luminous flux of the backward diffuse component is, in general, in the range of but preferably less than the blue skylight fraction; and a reflected component, formed by reflected light and propagating along a direction at a mirror angle away from the room, a luminous flux of the reflected component depends, for example, on the incident angle of the light beam onto the panel backside.

It is noted that in other embodiments of the lighting system, a large area light source that allows, for example, a structural incorporation of the light source and the panel in one unit, may be used. Exemplary configurations of large area light sources are disclosed, for example, in the not yet published PCT/EP2015/069790 filed on 28 Aug. 2015, by the same applicants, which is incorporated herein by reference. Also in that case, the transmitted (directed non-diffuse) component (light beam portion 9) and the forward diffuse component, formed by scattered light (diffused light 7) are generated and emitted into the room by the lighting system (see also the disclosure in connection with FIGS. 6A to 6C).

That having being stated, the optical properties of light transparent panel 3 may be such that the blue skylight fraction is within the range from 5% to 50%, such within the range from 7% to 40%, or even in the range from 10% to 30%, or within the range from 15% to 20%;

the average CCT of the forward diffuse component is significantly higher than the average correlated color temperature CCT of the transmitted component, for example it may be higher by a factor of 1.2, or 1.3, or 1.5 or more;

light transparent panel 3 does not absorb significantly incident light, namely the sum of the four components is at least equal to 80%, or 90%, or even 95%, or 97% or more;

light transparent panel 3 scatters mostly forward, namely more than 1.1, or 1.3, or even 1.5, or 2 two times more than is back scattered; and/or light transparent panel 3 may have low reflection, namely less than a portion of 9%, or 6%, or even less than 3%, or 2% of the impinging light is reflected.

Generally, the light source can be, for example, a cool white light source. Exemplary embodiments of light sources may comprise LED based light emitters or discharge lamp based light emitters or hydrargyrum medium-arc iodide lamp based light emitters or halogen lamp based light emitters and respective optical systems downstream of the respective light emitter.

Light transparent panel 3 is generally configured for emitting diffused light 7 at a first color, e.g. in case of a sky imitation a bluish sky color and comprises front face 3A as a visible front area section that an observer can see when looking at it.

For example, the first color diffused light 7 and a second color of transmitted portion 9 of the light beam may be separated in the CIE 1976 (u',v') color space by, at least 0.008 such as at least 0.01, 0.025, or 0.04, where the color difference $\Delta u'v'$ is defined as the Euclidean distance in the u'v' color space. In particular for sun-imitation configurations, the illuminating light beam CCT of the second color may be close to the Planckian locus (e.g. in the range from 800 K to 6 500 K). In some embodiments the second color may correspond to u'v' points with a maximum distance from the Planckian locus of e.g. 0.06. In other words, a distance from the Planckian locus is, for example in the range from 800 K to 6500 K, given by $\Delta u'v' \leq 0.060$.

As it is apparent to the skilled person, depending on the specific interaction of light transparent panel 3 with the incident light beam, the color and/or CCT of transmitted portion 17 of the light beam may be affected. Depending on the type of nanoparticles and their concentration, the CCT difference between the incoming light and transmitted portion 17 may be, for example, at least 300 K or even 1000 K or more.

Figure 2:
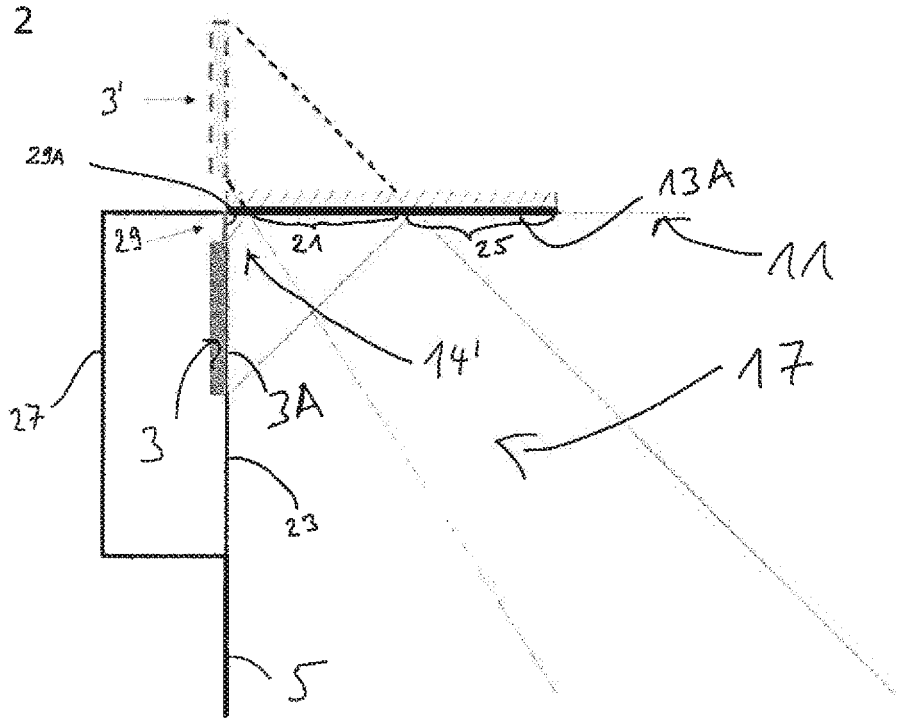
FIG. 2 is a schematic cross-sectional view illustrating the perception of an enlarged sky-perception providing unit.

Referring to the optical perception illustrated in FIG. 2, the observer, when looking from within the range of sun-observer locations at the edge of the room with lighting system 1, will see a, for example, blue area corresponding to front face 3A and a portion 21 of reflective face 13A from which the homogenously emitted diffused light at the first color is either directly perceived or indirectly via mirror unit 13 perceived. In FIG. 2, the virtual image 3' of the reflected panel 3 is indicated by dashed lines. The blue area is surrounded by a surrounding area 23 (see also FIG. 1A) that is either a portion of the wall looked at directly or that is seen in reflection. The portion looked at directly of surrounding area 23 may be a part of the room or of unit 2. It may be a portion of wall 5 or ceiling 11. In general, it surrounds three sides of front face 3A with the exception of the side next to reflective face 13A. The portion looked at in reflection is physically a portion 25 on reflective face 13A next to portion 21. In addition, the observer will see a sun-like circular spot 19 (see FIG. 1A) at the second color caused by the reflected (directed non-diffuse) component of the light of the light source, specifically of reflected light beam 17.

For completeness, in FIG. 2 it is further illustrated that the lighting system may comprise some housing 27 for the light source that is positioned behind wall 5. It is further pointed out that in the exemplary embodiment of FIG. 2 a transition unit 29 is provided between the upper end of panel 3 and the portion of ceiling 11 formed by reflective face 13A. The effect will be discussed after the following detailed discussion of further features of light transparent panel 3.

The nanoparticle-based Rayleigh-like diffusing material used in the panel may, for example, comprise a solid matrix of a first material (e.g. resins having excellent optical transparency), wherein nanoparticles of a second material (organic or inorganic nanoparticles such as ZnO, TiO2, SiO2, Al2O3 and similar) are dispersed which have, for example, an index of refraction $n_p$=2.0, 2.6, 2.1, 1.5, and 1.7, respectively, and any other oxides which are essentially transparent in the visible region. In the case of inorganic particles, an organic matrix or an inorganic matrix may be used to embed the particles such as soda-lime-silica glass, borosilicate glass, fused silica, polymethylmethacrylate (PMMA), and polycarbonate (PC). In general, also organic particles may be used, in particular for illuminated configurations having, for example, a reduced or no UV portion.

In some embodiments, the panel may be reduced to a layer or coating on a substrate. In any case, the refractive indexes of the two materials are different, and this mismatch on the refractive index on the nano-scale is responsible of the Rayleigh-like scattering phenomenon. The absorption of the first and the second material in the visible wavelength range can be considered negligible. Moreover, panel 3 may be uniform in the sense that, given any point on the front face 3A, the physical characteristics of the panel in that point do not depend on the position of that point. The nanoparticles may be monodisperse or polydisperse. The shape of the nanoparticle can essentially be any, while spherical particles are most common.

Diameter, refractive index mismatch, and areal density (number per square meter) of the nanoparticles are the parameters that define the cross section of the scattering phenomenon in the chromatic panel. In addition, the amount of the impinging light scattered from the chromatic panel increases by increasing one of the parameters mentioned above. In order to simplify the description we can consider just the regular transmittance property T(λ) of the material at a certain wavelength. Herein, as defined in the Standard Terminology of Appearance, ASTM international, E 284-09a, the transmittance is in general the ratio of the transmitted flux to the incident flux in the given conditions. The regular transmittance T(λ) is the transmittance under the undiffused angle, i.e. the angle of incidence. In the context of the present disclosure, for a given wavelength and a given position on the chromatic diffusing layer, the regular transmittance is intended for non-polarized incident light with an incident angle corresponding to the main light beam propagation.

To obtain a sun-sky imitating lighting system, some particular range of regular transmittance are required. Note that both the first material (the matrix) and the second material (nanoparticles) are almost non-absorbing in the visible range, so the portion of the light that is not regular transmitted is totally scattered in the Rayleigh-like scattering mode. Regarding the transmission of the panel, the regular transmittance for the blue T[450 nm] may be in general within the range [0.05-0.9]. In particular in some embodiments aiming at a pure clear sky the range would be [0.3-0.9], such as [0.35-0.85] or even [0.4-0.8]; in the embodiments aiming at a Nordic sky the range would be [0.05-0.3], such as [0.1-0.3] or even [0.15-0.3].

It is well known from fundaments of light-scattering that a transparent optical panel comprising a transparent matrix and transparent nanoparticles having different refraction index with respect to the matrix, and having sizes (significantly) smaller than visible wavelength, will preferentially scatter the blue part (the blue) of the spectrum, and transmit the red part (the red). While the wavelength-dependence of the scattering efficiency per single particle approaches the $\lambda^{-4}$ Rayleigh-limit law for particle sizes smaller or about equal to 1/10 of the wavelength λ, a respective acceptable optical effect may be reached already in the above range for the size of the nanoparticles. In general, resonances and diffraction effects may start to occur at sizes larger, for example, than half the wavelength.

On the other side, the scattering efficiency per single particle decreases with decreasing particle size d, proportional to $d^{-6}$, making the usage of too small particle inconvenient and requiring a high number of particles in the propagation direction, which in turn may be limited by an allowed filling-fraction. For example, for thick scattering layers, the size of the nanoparticles embedded in the matrix (and in particular their average size) may be in the range from 10 nm to 250 nm, such as 20 nm to 100 nm, e.g. 20 nm to 50 nm, and, for compact devices, e.g. using thin layers such as coatings and paints, the size may be in the range from 10 nm to 250 nm, such as 50 nm to 180 nm, e.g. 70 nm to 120 nm. For non-spherical particles, the effective diameter is the diameter of the equivalent spherical particle, namely the effective diameter spherical particle having similar scattering properties as the aforementioned nanoparticles.

In some embodiments, larger particles may be provided within the matrix with dimensions outside that range but those particles may not affect the Rayleigh-like feature and, for example, only contribute to forming a low-angle scattering cone around the specular reflection.

The chromatic effect is further based on the nanoparticles having a refractive index that is different than the refractive index of the embedding matrix. To scatter, the nanoparticles have a real refractive index $n_p$ sufficiently different from that of the matrix $n_h$ (also referred to as host material), in order to allow light scattering to take place. For example, the ratio m between the particle and host medium refractive indexes (with $$\left(\text{with } m \equiv \frac{n_p}{n_h}\right)$$

may be in the range 0.5≤m≤2.5 such as in the range 0.7≤m≤2.1 or 0.7≤m≤1.9.

The chromatic effect is further based on the number of nanoparticles per unit area seen by the impinging light propagating in the given direction as well as the volume-filling-fraction f. The volume filling fraction f is given by $$f = \frac{4}{3}\pi\left(\frac{d}{2}\right)^3 \rho$$

with ρ [meter$^{-3}$] being the number of particles per unit volume. By increasing f, the distribution of nanoparticles in the diffusing layer may lose its randomness, and the particle positions may become correlated. As a consequence, the light scattered by the particle distribution experiences a modulation which depends not only on the single-particle characteristics but also on the so called structure factor. In general, the effect of high filling fractions is that of severely depleting the scattering efficiency. Moreover, especially for smaller particle sizes, high filling fractions impact also the dependence of scattering efficiency on wavelength, and on angle as well. One may avoid those "close packing" effects, by working with filling fractions f≤0.4, such as f≤0.1, or even f≤0.01.

Moreover, nanoparticles may be distributed inside the panel in a manner such that their areal density, namely the number N of nanoparticles per square meter, i.e. the number of nanoparticles within a volume element delimited by a portion of the surface of the panel having an area of 1 m$^2$, satisfies the condition N≥Nmin, where:

$$N_{min} = \upsilon \frac{10^{-29}}{D^6} \cdot \left|\frac{m^2+2}{m^2-1}\right|^2$$

wherein v is a dimensional constant equal to 1 m$^6$, Nmin is expressed as a number/m$^2$, the effective diameter D=d $n_h$ is expressed in meters and wherein m is the ratio between the particle and host medium refractive indices. Thereby, d [meter] is the average particle size defined as the average particle diameter in the case of spherical particles, and as the average diameter of volume-to-area equivalent spherical particles in the case of non-spherical particles, as defined in [T. C. GRENFELL, AND S. G. WARREN, "Representation of a non-spherical ice particle by a collection of independent spheres for scattering and absorption of radiation". Journal of Geophysical Research 104, D24, 31,697-31,709. (1999)]. The effective particle diameter is given in meters or, where specified in nm.

In some embodiments:

$$N \geq N_{min} = \frac{7.13\times10^{-29}}{D^6}\left|\frac{m^2+2}{m^2-1}\right|^2 [\text{meters}^{-2}],$$

(D given in [meters]) and $$N \leq N_{max} = \frac{2.03\times10^{-27}}{D^6}\left|\frac{m^2+2}{m^2-1}\right|^2 [\text{meters}^{-2}]$$

Considering the transmission configuration:

For example, for embodiments aiming at simulating the presence of a pure clear sky, $$N \geq N_{min} = \frac{4.76\times10^{-29}}{D^6}\left|\frac{m^2+2}{m^2-1}\right|^2 [\text{meters}^{-2}],$$

(D given in [meters]) and $$N \leq N_{max} = \frac{5.44\times10^{-28}}{D^6}\left|\frac{m^2+2}{m^2-1}\right|^2 [\text{meters}^{-2}]$$

such as $$N \geq N_{min} = \frac{7.34\times10^{-29}}{D^6}\left|\frac{m^2+2}{m^2-1}\right|^2 [\text{meters}^{-2}] \text{ and}$$

$$N \leq N_{max} = \frac{4.74\times10^{-28}}{D^6}\left|\frac{m^2+2}{m^2-1}\right|^2 [\text{meters}^{-2}],$$

more specifically $$N \geq N_{min} = \frac{1.01\times10^{-28}}{D^6}\left|\frac{m^2+2}{m^2-1}\right|^2 [\text{meters}^{-2}] \text{ and}$$

$$N \leq N_{max} = \frac{4.14\times10^{-28}}{D^6}\left|\frac{m^2+2}{m^2-1}\right|^2 [\text{meters}^{-2}].$$

In other embodiments aiming at simulating a Nordic sky, $$N \geq N_{min} = \frac{5.44\times10^{-28}}{D^6}\left|\frac{m^2+2}{m^2-1}\right|^2 [\text{meters}^{-2}],$$

(D given in [meters]) and $$N \leq N_{max} = \frac{1.35\times10^{-27}}{D^6}\left|\frac{m^2+2}{m^2-1}\right|^2 [\text{meters}^{-2}]$$

such as $$N \geq N_{min} = \frac{5.44\times10^{-28}}{D^6}\left|\frac{m^2+2}{m^2-1}\right|^2 [\text{meters}^{-2}] \text{ and}$$

$$N \leq N_{max} = \frac{1.04\times10^{-27}}{D^6}\left|\frac{m^2+2}{m^2-1}\right|^2 [\text{meters}^{-2}],$$

more specifically $$N \geq N_{min} = \frac{5.44 \times 10^{-28}}{D^6} \left| \frac{m^2+2}{m^2-1} \right|^2 [\text{meters}^{-2}] \text{ and}$$

$$N \leq N_{max} = \frac{8.57 \times 10^{-28}}{D^6} \left| \frac{m^2+2}{m^2-1} \right|^2 [\text{meters}^{-2}].$$

In some embodiments, the nanoparticles are distributed homogenously, at least as far as the areal density is concerned, i.e. the areal density is substantially uniform on the panel, but the nanoparticle distribution may vary across the panel. The areal density varies, for example, by less than 5% of the mean areal density. The areal density is here intended as a quantity defined over areas larger 025 $mm^2$.

In some embodiments, the areal density varies, so as to compensate illumination differences over the panel, as lit by the light source. For example, the areal density N(x,y) at point (x,y) may be related to the illuminance I(x,y) produced by the light source at point (x,y) via the equation N(x,y) =Nav*Iav/I(x,y)±5%, where Nav and Iav are the averaged illuminance and areal density, these latter quantities being averaged over the surface of the panel. In this case the luminance of the panel may be equalized, in spite of the non-uniformity of the illuminance profile of light source on the panel. In this context, the luminance is the luminous flux of a beam emanating from a surface (or falling on a surface) in a given direction, per unit of projected area of the surface as viewed from the given direction, and per unit of solid angle, as reported, as an example, in the standard ASTM (American Society for Testing and Materials) E284-09a.

In the limit of small D and small volume fractions (i.e. thick panels) an areal density N=Nmin is expected to produce scattering efficiency of about 5%. As the number of nanoparticles per unit area gets higher, the scattering efficiency is expected to grow proportionally to N, until multiple scattering or interferences (in case of high volume fraction) occur, which might compromise color quality. The choice of the number of nanoparticles is thus biased by the search for a compromise between scattering efficiency and desired color, as described in detail in EP 2 304 478 A1. Furthermore, as the size of nanoparticles gets larger, the ratio of the forward to backward luminous flux grows, such ratio being equal to one in the Rayleigh limit. Moreover, as the ratio grows, the aperture of the forward scattering cone gets smaller. Therefore, the choice of the ratio is biased by the search for a compromise between having light scattered at large angles and minimizing the flux of backward scattered light.

As will be apparent from the above, the homogeneity of the diffuse light generated across the panel depends on the incoming light profile. Assuming, for example, oblique incidence, due to the divergence of the beam, the first hit area of panel 3 (lower portion in FIG. 2) may be subject to a slightly higher light intensity as the last hit area (upper portion in FIG. 2). Accordingly, a slight change or gradient in "sky" color may be present. Assuming now that the gradient is reflected due to mirror unit 13, a potentially unnatural impression may occur that reduces the infinite depth perception that could in principle be achieved by light transparent panel 3 being illuminated by a respective configured light source.

Figure 3:
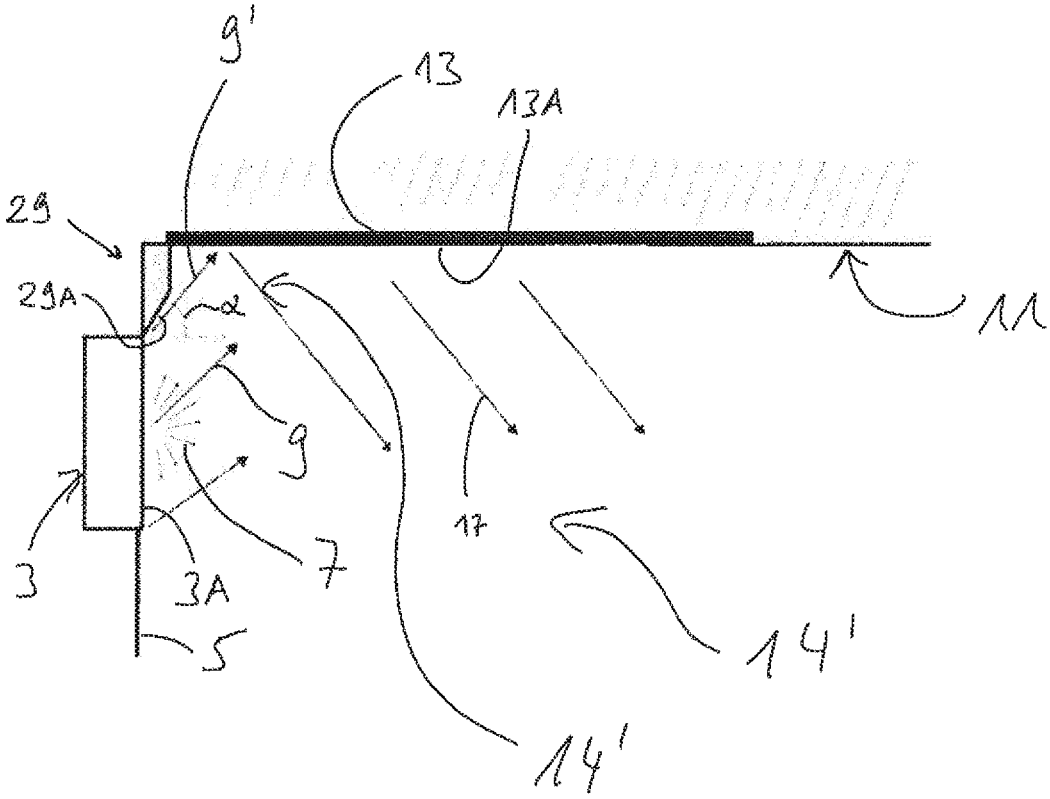
FIG. 3 is a schematic cut view for an illustration of an exemplary configuration of a transition unit of an enlarged sky-perception providing unit.

A transition unit 29 illustrated in FIG. 2 can create artificially a strong contrast across the perceived window area that overcomes the sensibility of the eye for the above illustrated change in gradient. Configuring the transition unit 29 accordingly may reduce or even avoid the perception of the change in gradient by an observer. Transition unit 29 may form the transition between front face 3A and reflective face 13A, and in particular may extend along the neighboring border regions of front face 3A of light transparent panel 3 and of reflective face 13A of mirror unit 13. As shown in FIG. 3, transition unit 29 may extend along a very inner edge portion 14' of inner edge 14 formed by unit 2.

However, it is noted that portion 9 of the transmitted light beam should not be incident on the surface of transition unit 29 because portion 9 is directed upwards. Any illumination by portion 9 would thus be contrary to the expected illumination by the sun.

FIG. 3 illustrates that the shape of transition unit 29 may be configured generally such that its face 29A next to front face 3A extends under an angle α that is larger than the emerging angle associated with portion 9, i.e. the main direction plus the beam divergence of the direct light beam. The difference in orientation of face 29A and the beam results in the visualized opening between arrow 9' and face 29A.

Transition unit 29 may generally be configured to create a visually perceived discontinuity (break in appearance) between the perceived image of front face 3A and a perceived reflected image 3' of front face 3A. For that purpose, transition unit 29 may comprise a perceived transition surface (e.g. face 29A) made of at least one of a white, an absorbing, and a translucent material. Transition unit 29 is in particular positioned outside of transmitted portion 9 of the light beam. Specifically, transition unit 29 is not illuminated by the transmitted portion 9 of the direct light beam.

Exemplary shapes include a plane viewable face 29A (e.g. coplanar with respect to the front face 3A or angled with respect to front face 3A and reflective face 13A when provided by a—in cross-section—triangular shape of transition unit 29) or a concave viewable face or a step-wise planar shape is illustrated in FIG. 3.

Figure 4A:
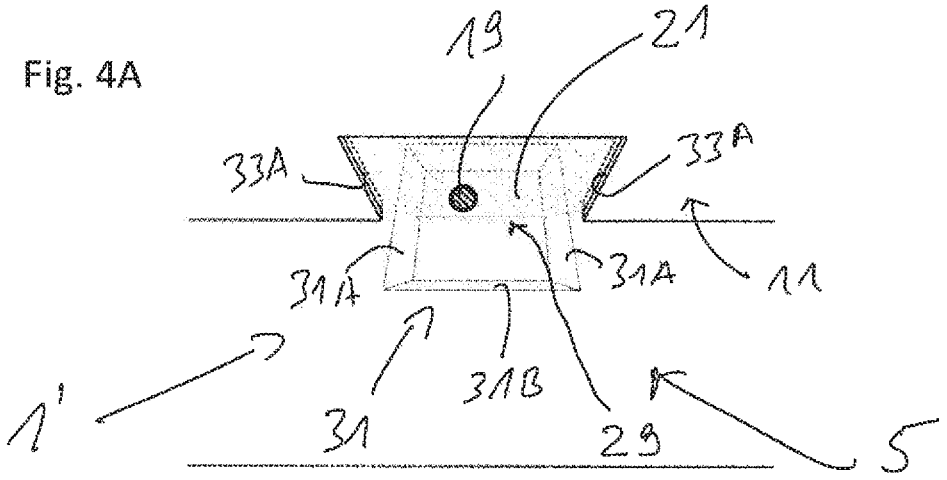
FIGS. 4A to 4C are 3D-views and a schematic cross-sectional view of exemplary lighting systems configuration with a lightwell feature.
Figure 4B:
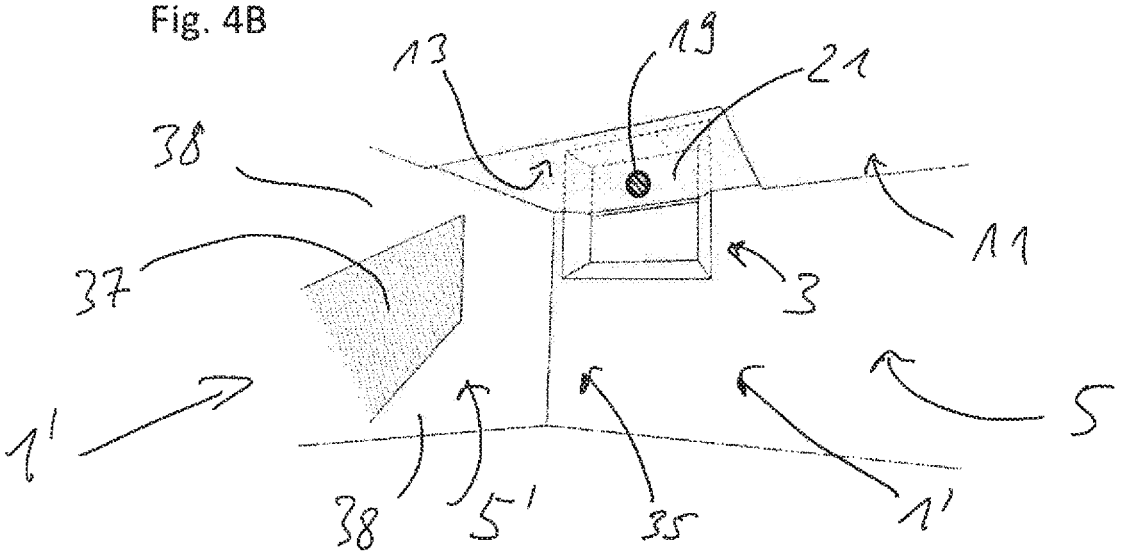
Figure 4C:
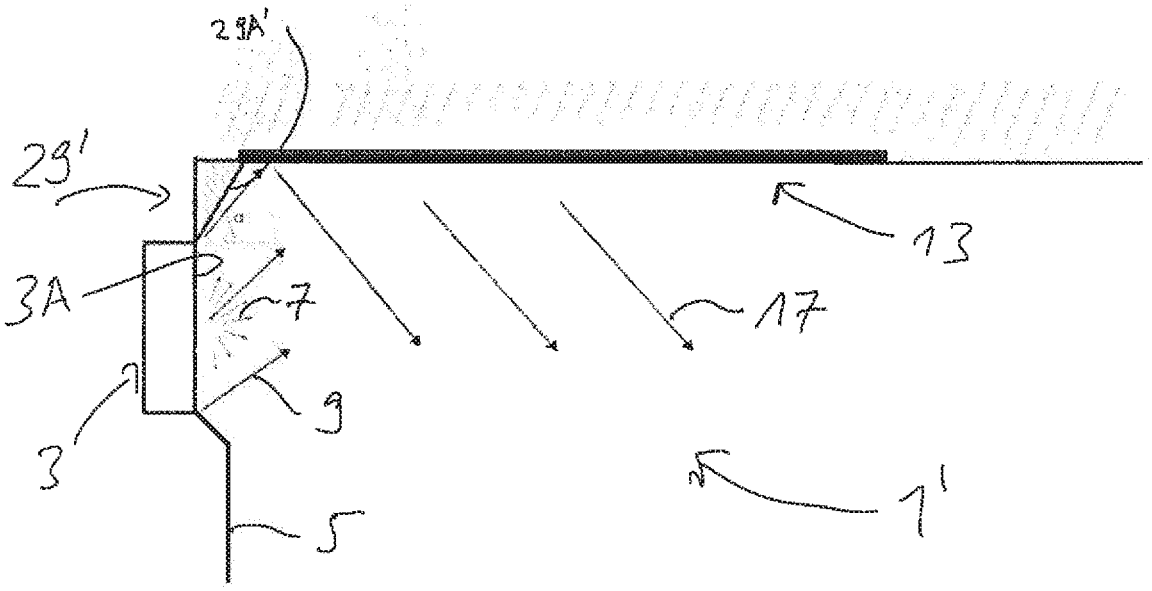

In the exemplary embodiments of FIGS. 4A to 4C, the lighting systems comprise a light well structure 31 that forms a frame-like area extending next to and partially surrounding front face 3A. Specifically, the embodiment of the lighting system 1' illustrated in FIG. 4A is similar to the one of FIG. 1A with the difference that light transparent panel 3 is provided at the bottom of a light well structure 31 that is formed in wall 5. Light well structure 31 extends along the lower side as well as the right and left sides of panel 3. Faces 31A at the sides of the light well structure 31 open towards the room with an opening angle that avoids any contact of transmitted portion 9 of the light beam with those faces 31A, thereby not introducing an unnatural upward illumination that would stand in contrast to the reflected image in mirror unit 13. Face 31B cannot be illuminated do to the upward propagation direction of transmitted portion 9.

Furthermore, in the embodiment of FIG. 4A also mirror unit 13 is provided in a recess with side walls 33A. However, as the reflective face 13A is larger than the size of transmitted beam portion 9, also those side walls 33A are not illuminated by transmitted light beam 9. However, they can in general be illuminated by diffused light 7.

As in FIG. 1A, due to the downward reflection of the beam, the sun appears only in portion 21 of reflective face 13A, i.e. in the perceived upper half of the window, i.e. in the reflection of the "real" window imitation (front face 3A). Moving further away from the "window" in an orthogonal direction will make the sun disappear at the transition region between the "real" window imitation and the reflected "real" window imitation, i.e. in the middle of the window which would be unnatural and not expected by the observer. Selecting, for example, the geometry of the room as well as the depth of the recess into which mirror unit 13 is mounted may reduce the observer regions prone to that unrealistic disappearance of the sun.

Moreover, transition unit 29 is indicated in FIG. 4A to extend across the "perceived complete window" between the "real" window imitation and the reflected "real" window imitation. Any inhomogeneity across the "real" window imitation and the reflected "real" window imitation will thereby be less noticeable by an observer. Moreover, the size of transition unit 29 may also cover to some degree the unnatural disappearance of the sun at the center of the perceived window imitation.

FIG. 4B illustrates an installation of lighting system 1' of FIG. 4A close to a corner 35 of the room. Accordingly, a second side wall 5' extends along the beam propagation direction. Due to selected propagation direction and/or the divergence of reflected light beam 17, some light will hit side wall 5' and emphasize the sun beam character by a lit up region 37 next to non-lit up regions 38 on wall 5'. It is noted that due to the reflective configuration, lit up region 37 at wall 5' in principle tracks back along its borders only to top half 21 of the window imitation. However, installing lighting system 1' with some distance to side wall 5' will make it difficult to link lit up region 37 only to that top half 21.

In FIG. 4C, a cut view further illustrates the light well aspect. Front face 3A of panel 3 is recessed with respect to wall 5. Lower transition face 31B—extending from front face 3A to the surface of wall 5—clearly could not be illuminated by transmitted beam portion 9 but it may be illuminated by diffused light 7. In addition, an alternative shape of a transition element 29' with a tilted face 29A' is illustrated that again is not illuminated by transmitted beam portion 9.

It is noted that in all embodiments disclosed herein, the size of reflective face 13A is larger than the size of front face 3A, and even larger than the projection of transmitted portion 9 on reflective face 13A. This ensures that no unnatural upward illumination affects the perception at the border of reflective face 13A. For example, the size is—depending of the angle at which transmitted light beam portion 9 propagates upward—at least as large as an area having the same shape as the reflective face that is illuminated by transmitted portion 9 of the light beam. The description of the size of the projected beam on the mirror unit is affected by various features such as the tilt angle and the shape of the front face. The shape of the illuminated area may be, for example, a trapezoid (and not a rectangle due to the 45° tilted direction of the transmitted beam). Moreover, considerations about the illuminance profile need to be considered as well as the beam divergence, itself. The quantification of the required size of the reflective face can be made by considering the source distance and the beam divergence and then quantifying the size of the illuminated area. The size, of course, also is related to the orientation of the reflective face with respect the beam propagation axis. For example, a reflective face orthogonal to the main beam at a distance of 6 m should be bigger than 1.6 m×0.5 m considering a full divergence of 30° and 10° in the respective directions. This is illustrated, for example, in the cut view of FIG. 4C by the fact that arrows are shown only at the left half of the drawing to illustrate reflected beam 17.

Figure 5A:
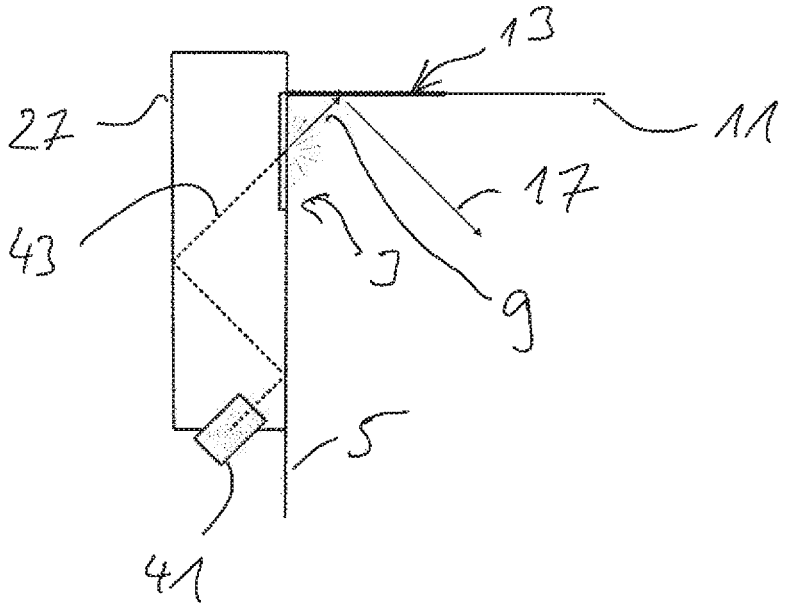
FIGS. 5A and 5B are schematic cross-sectional views of exemplary behind the wall installations based on embodiments of lighting systems using a separate light source for generating a light beam that is guided to illuminate a panel for diffused light generation.
Figure 5B:
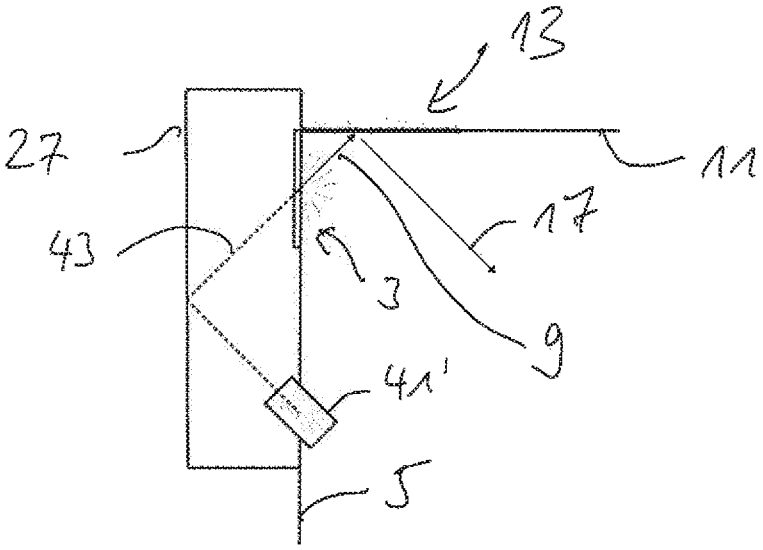

For two embodiments similar to the one of FIG. 2, FIGS. 5A and 5B illustrate the optical layout within housing 27 behind wall 5. The embodiment of FIG. 5A corresponds essentially to the use of the lighting system disclosed in EP 2 920 508 A1. A light source 41 projects a light beam 43 onto the backside of panel 3. To guide light beam 43, two reflectors (not explicitly shown) are provided within housing 27. The reflectors are arranged and configured in particular as folding optics to reduce the dimension of lighting system 1.

The modified embodiment of FIG. 5B distinguishes in its optical layout by guiding light beam such that light source 41' is easily accessible from within the room. E.g. light source 41' may reach into the room as shown in FIG. 5B or may still lay within the level of the wall. In any case, servicing light source 41' is simple as it is, e.g. easier accessible than light source 41.

Light sources 41 and 41' are configured to emit a direct light beam (i.e. light beam 43) through light transparent panel 3 onto mirror unit 13 such that a transmitted portion 9 of the light beam is reflected completely by reflective face 13A, thereby creating reflected direct light beam 17 in particular for imitating a sun beam within the room.

In general, the light source and the light transparent panel 3 are configured to provide for transmitted portion 9 of light beam 43 as being non-diffused directed light with a first correlated color temperature and extending along a main light beam direction and to generate the diffused light within panel 3 at a second correlated color temperature.

In general, light source is positioned upstream light transparent panel 3 and/or generates—as light beam 43—a direct light beam that is collimated. Examples of the light sources as used in FIGS. 5A and 5B are specific projectors with e.g. two different divergences in orthogonal planes such as FWHM apertures of 30° and 10°, or similar, able to project e.g. a rectangle.

Another example of a light source are large area light sources that are configured to emit a collimated direct light beam from, for example, a large planar emitting face and wherein, for the collimated direct light beam, a beam with FWHM divergence smaller than 10° is generated.

In general regarding the size of the mirror unit of the herein disclosed embodiments, specifically the reflective face and the surface area of the reflective face, the transmitted portion of the light beam, i.e. after the "window" imitation by the front face, produces an illumination profile on the mirror plane, i.e. the plane corresponding to the reflective face. The regions of this profile with an illuminance greater than 5% of the maximum illuminance are associated with an area equal to $A_{5\%}$. The reflective face has to cover (to collect) all those regions and its total area should be equal to at least $A_{5\%}$ such $A_{5\%}$ plus 5%, 15%, 30% of $A_{5\%}$.

Figure 6A:
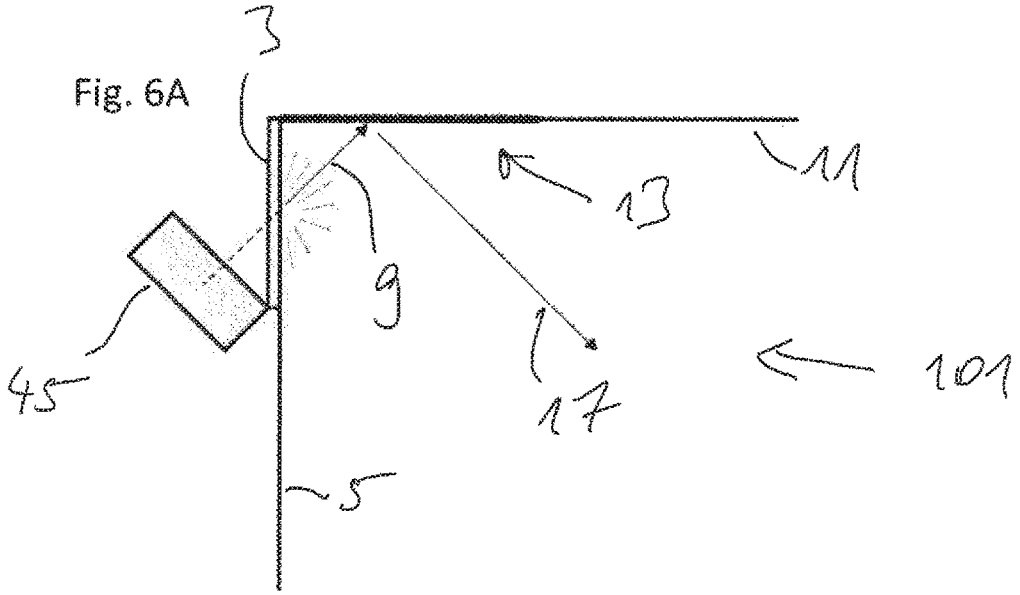
FIGS. 6A to 6C are schematic cross-sectional views of a behind the wall installation and two behind the ceiling installations based on embodiments of lighting systems using a large area light source for generating direct light, for example, close to the panel for diffused light generation.
Figure 6B:
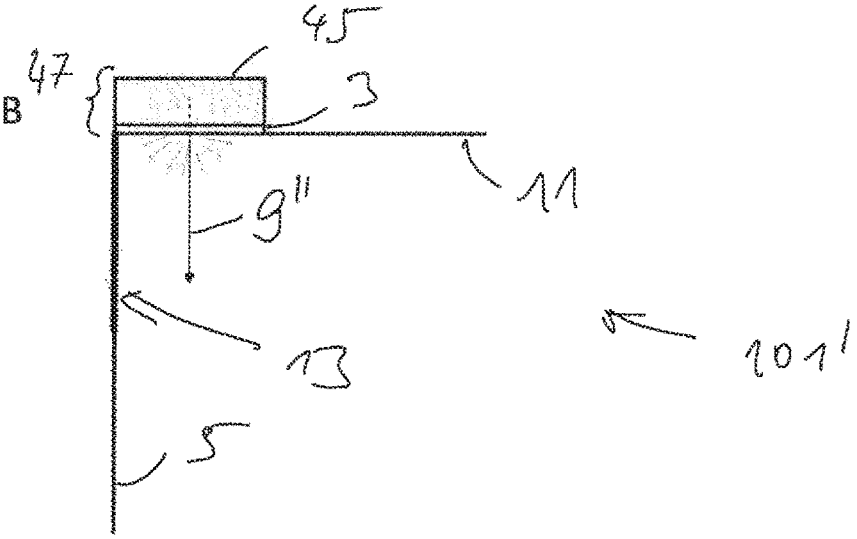
Figure 6C:
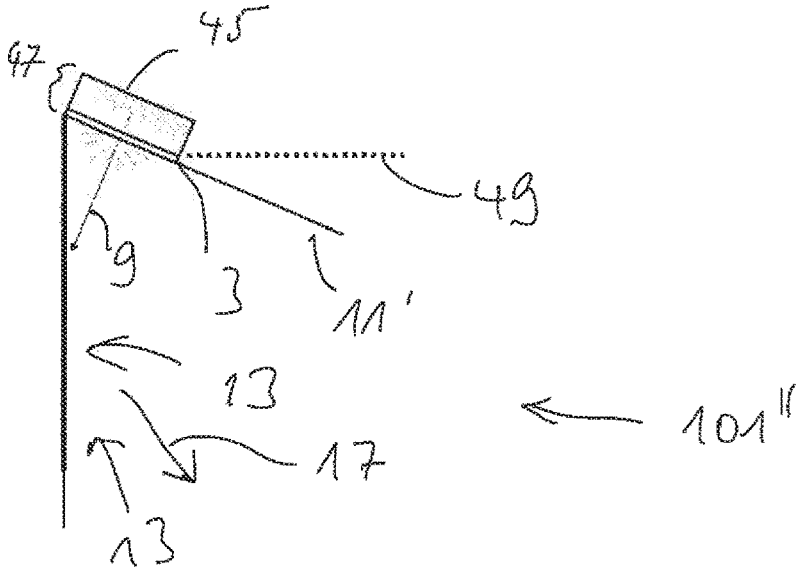

FIGS. 6A to 6C illustrate lighting systems 101, 101', 101" that are based on compact light beam generator configurations such as the ones disclosed in the above mentioned PCT/EP2015/069790. Those configurations may comprise a light beam generator 45 attached to or separated from panel 3. In the disclosed embodiments, it is assumed that the light beam emerges essentially orthogonally from a light emitting face of compact light beam generator 45 that essentially is as large or larger in size than panel 3.

In the embodiment of FIG. 6A, compact light beam generator 45 is tilted behind wall 5 and positioned to illuminate panel 3 completely. Accordingly, lighting system 101 of FIG. 6A corresponds in appearance essentially to lighting system 1 of FIG. 1A.

In the modified lighting system 101' of FIG. 6B, a compact light unit 47 comprises compact light beam generator 45 that is combined with panel 3. For example, panel 3 is attached to the emitting face of light beam generator 45.

Compact light unit 47 is mounted at ceiling 11 such that light beam portion 9" propagates alongside wall 5 from top to bottom. Mirror unit 13 is in this case positioned at wall 5 next to and orthogonal to compact light unit 47, i.e. specifically to panel 3 attached to it.

An observer will also in this case perceive an extended size of the imitated window because—assuming that the installation of the mirror unit is provided above the observer's eye height, the observer will see the reflected diffuse light from panel 3. However, in this embodiment, an observer will see the sun only of he is essentially below compact light unit 47 such that in those positions mirror unit 13 will not contribute that much to an increased window perception.

Finally, FIG. 6C illustrates an embodiment, in which thin compact light beam source 45 and panel 3 again form a compact light unit 47. Compact light unit 47 is mounted at an oblique ceiling 11' such that a tilted propagation angle of portion 9 with respect to the vertical direction exists. Accordingly, beam portion 9 can be directed onto mirror unit 13 that is in this configuration mounted again at wall 5 next to compact light beam unit 47. In reflection from panel 3, light beam 17 may be seen from within an observer range. Depending on the incidence angle onto mirror unit 13 and a height of the room, that observer range may be close to wall 5 or extend into the room.

As further indicated by dotted line 49 in FIG. 6C, the ceiling may alternatively extend mainly horizontally and only the tilted and as a window perceived portion of the ceiling is formed by compact light beam unit 47.

For completeness it is noted that in some embodiments, a secondary chromatic diffusing layer associated light source may be used, for example, for an additional illumination of the chromatic diffusing layer from the side. Exemplary embodiments are disclosed, for example, in WO 2009/156347 A1. In those embodiments, the chromatic diffusing layer may be configured to interact primarily with the light of that secondary light source or with the light from both light sources to provide for diffused light 7.

In some embodiments, the front face and/or the reflective face are essentially formed as planar surfaces that are, for example, arranged with respect to each other at the inner edge angle.

While the exemplary embodiments shown herein are based on rectangular shapes for the front faces and the reflective faces that have essentially one border extending side by side (or displaced by the transition unit), alternative shapes are possible such as a triangular front face combined with a larger triangular or rectangular reflective face. In general, the shape is determined by the feasibility of the light source, specifically the light beam.

Moreover, the herein disclosed ranges of beam propagation directions may vary with respect to, for example, the vertical direction in dependence of the specific type and orientation of the installation within a room, for example.

Transparent or partially transparent—as used herein for the light transparent panel—refers to the system's capacity to transmit, at least partially, an image forming light beam. In other terms, a partially transparent panel refers to, in the contest of the herein disclosed embodiments, to a panel that transmits at least 40% such as 60%, 80% or more of a collimated red light beam which impinges normally to the panel. In this consideration, transmitted light includes all the light that propagates into a cone of forward directions, where the cone has a FWHM aperture smaller than 10°, such as 7 or smaller, e.g. 5° or smaller, and has its axis aligned on the original propagation direction. In this context, "collimated" refers to a beam with FWHM divergence smaller than 2° and, red light is e.g. a beam having a spectral distribution in the range from 650 nm to 700 nm.

Although the preferred embodiments of this invention have been described herein, improvements and modifications may be incorporated without departing from the scope of the following claims.

The invention claimed is:

1. A sun-sky imitating lighting system for forming a room edge of a room, the lighting system comprising:

an enlarged sky-perception providing unit with a light transparent panel and a mirror unit with a reflective face forming an inner edge with respect to each other, and a light source configured to emit a direct light beam through the light transparent panel onto the mirror unit such that the transmitted portion of the light beam is reflected completely by the reflective face, thereby creating a reflected direct light beam, wherein the light transparent panel is configured to emit diffused light from a front face, the mirror unit comprises a reflective face positioned next to the light transparent panel to form the inner edge together with the light transparent panel, and the size of the light transparent panel is smaller than the size of the mirror unit.

2. A sun-sky imitating lighting system for forming part of a room edge of a room, the lighting system comprising:

an enlarged sky-perception providing unit with a light transparent panel having a front face and a mirror unit with a reflective face forming an inner edge with respect to each other, and a light source configured to emit a direct light beam through the light transparent panel in a manner that a transmitted portion of the light beam passes by the mirror unit, wherein the light transparent panel and the mirror unit form the inner edge, wherein the light transparent panel is configured to emit diffused light from a front face, the mirror unit comprises a reflective face positioned next to the light transparent panel to form the inner edge together with the light transparent panel, and the size of the light transparent panel is smaller than the size of the mirror unit.

3. The lighting system of claim 1, wherein the size along the direction of the inner edge of the light transparent panel is smaller than the size of the mirror unit along the direction along the inner edge, or wherein at least one of a width (Wf) of the front face is smaller than a width (Wr) of the reflective face and a height (Hf) of the front face is smaller than a height (Hr) of the reflective face.

4. The lighting system of claim 1, wherein the inner edge has an inner edge angle (β) under which the front face extends with respect to the reflective face and the inner edge angle (β) is in the range from about 50° to 130° or from about 70° to 110° or between 80° and 100° or at about 90°.

5. The lighting system of claim 1, wherein the light transparent panel comprises a plurality of nanoparticles embedded in a matrix and configured to provide for a direct transmission of visible light that is larger in the red than in the blue and for a diffuse transmission that is larger in the blue than in the red.

6. The lighting system of claim 1, further comprising at least one of a transition unit forming the transition between the front face and the reflective face, a transition unit extending along the neighboring border regions of the front face of the light transparent panel and of the reflective face of the mirror unit, and a transition unit extending along a very inner edge portion of the formed inner edge.

7. The lighting system of claim 6, wherein the transition unit is configured to create a visually perceived discontinuity between the perceived image of the front face and the perceived reflected image of the front face, or wherein the transition unit comprises a perceived transition surface made of at least one of a white material, an absorbing material, and a translucent material.

8. The lighting system of claim 1, wherein at least one of the light source is positioned upstream the light transparent panel, the direct light beam is a collimated light beam, the light source is a projector or a large area light source configured to emit a collimated direct light beam with a full width at half maximum (FWHM) divergence smaller than 10°, the light source and the light transparent panel are configured to provide for a transmitted portion of the light beam being non-diffused directed light with a first correlated color temperature and extending along a main light beam direction and to provide for the diffused light at a second correlated color temperature, and the enlarged sky-perception providing unit further comprises a transition unit that is provided in the space between neighboring borders of the front face of the of the light transparent panel and of the reflective face of the mirror unit, and the transition unit is positioned outside of the transmitted portion of the light beam.

9. The lighting system of claim 2, wherein the front face and the reflective face extend essentially orthogonal with respect to each other and the transmitted portion of the light beam propagates essentially parallel to or away from the reflective face.

10. A room of a building, the room comprising:

a room edge formed by a side wall and a ceiling, and a lighting system, wherein the lighting system comprises an enlarged sky-perception providing unit including a light transparent panel and a mirror unit with a reflective face forming an inner edge, and a light source;

wherein:

the light source is configured to emit a direct light beam through the light transparent panel onto the mirror unit such that a transmitted portion of the light beam is reflected completely by the reflective face thereby creating a reflected direct light beam for imitating a sun beam, or the light source is configured to emit a direct light beam through the light transparent panel in a manner that a transmitted portion of the light beam passes by the mirror unit;

wherein:

the light transparent panel is configured to emit diffused light from a front face;

the mirror unit comprises a reflective face positioned next to the light transparent panel to form the inner edge together with the light transparent panel;

the size of the light transparent panel is smaller than the size of the mirror unit; and the light transparent panel and the mirror unit of the sky-perception providing unit are provided at the wall and the ceiling, respectively, or vice versa, to form an inner edge representing the transition between the side wall and the ceiling.

11. The room of claim 10, wherein the enlarged sky-perception providing unit comprises a light transparent panel with a front face and a mirror unit with a reflective face, and the room further comprises a surrounding area being a portion of the wall or the ceiling and surrounding the remaining three sides of the front face with the exception of the side next to the reflective face, thereby allowing the complete front face being viewable in reflection with at least a part of the surrounding area.

12. The room of claim 10, wherein the enlarged sky-perception providing unit of the lighting system forms a portion of the room edge.

13. The room of claim 10, wherein the light source is configured to emit a direct light beam in an upward direction through the light transparent panel and the reflective face is configured to form a part of the ceiling of a room, and the reflective face is arranged to reflect the transmitted portion of the direct light beam in a downward direction as a reflected direct light beam.

14. The room of claim 10, wherein at least one of the light transparent panel and the mirror unit is surrounded by a light well, the light well being part of the wall, the ceiling, or the lighting system and wherein the lighting system is configured such that the surfaces of the light well are positioned outside of the transmitted portion of the light beam, and are not illuminated by the transmitted portion of the direct light beam being emitted through the light transparent panel.

15. The lighting system of claim 2, wherein the size along the direction of the inner edge of the light transparent panel is smaller than the size of the mirror unit along the direction along the inner edge, or wherein at least one of a width (Wf) of the front face is smaller than a width (Wr) of the reflective face and a height (Hf) of the front face is smaller than a height (Hr) of the reflective face.

16. The lighting system of claim 1, wherein the unit is configured such that the diffused light as well as the reflection of the diffused light is at least partly emitted into the inner edge angular region.

17. The lighting system of claim 2, wherein the inner edge has an inner edge angle (β) under which the front face extends with respect to the reflective face and the inner edge angle (β) is in the range from about 50° to 130° or from about 70° to 110° or between 80° and 100° or at about 90°.

18. The lighting system of claim 2, wherein the unit is configured such that the diffused light as well as the reflection of the diffused light is at least partly emitted into the inner edge angular region.

19. The lighting system of claim 1, wherein the mirror unit is positioned next to the light transparent panel or in proximity, or at a distance smaller than a half, a third, or a quarter of an average width of the panel.

20. The lighting system of claim 2, wherein the light transparent panel comprises a plurality of nanoparticles embedded in a matrix and configured to provide for a direct transmission of visible light that is larger in the red than in the blue and for a diffuse transmission that is larger in the blue than in the red.

21. The lighting system of claim 2, wherein the mirror unit is positioned next to the light transparent panel or in proximity, or at a distance smaller than a half, a third, or a quarter of an average width of the panel.

22. The lighting system of claim 2, further comprising at least one of a transition unit forming the transition between the front face and the reflective face, a transition unit extending along the neighboring border regions of the front face of the light transparent panel and of the reflective face of the mirror unit, and a transition unit extending along a very inner edge portion of the formed inner edge.

23. The lighting system of claim 22, wherein the transition unit is configured to create a visually perceived discontinuity between the perceived image of the front face and the perceived reflected image of the front face, or wherein the transition unit comprises a perceived transition surface made of at least one of a white material, an absorbing material, and a translucent material.

24. The lighting system of claim 2, wherein at least one of the light source is positioned upstream the light transparent panel, the direct light beam is a collimated light beam, the light source is a projector or a large area light source configured to emit a collimated direct light beam with a full width at half maximum (FWHM) divergence smaller than 10°, the light source and the light transparent panel are configured to provide for a transmitted portion of the light beam being non-diffused directed light with a first correlated color temperature and extending along a main light beam direction and to provide for the diffused light at a second correlated color temperature, and the enlarged sky-perception providing unit further comprises a transition unit that is provided in the space between neighboring borders of the front face of the of the light transparent panel and of the reflective face of the mirror unit, and the transition unit is positioned outside of the transmitted portion of the light beam.

* * * * *